US005315977A

United States Patent [19]

Fosseen

[11] Patent Number: 5,315,977

[45] Date of Patent: May 31, 1994

[54] FUEL LIMITING METHOD AND APPARATUS FOR AN INTERNAL COMBUSTION VEHICLE

[76] Inventor: Dwayne Fosseen, 206 May St., P.O. Box 10, Radcliffe, Iowa 50230

[21] Appl. No.: 688,306

[22] Filed: Apr. 22, 1991

[51] Int. Cl.[5] ..... F02M 37/04

[52] U.S. Cl. ..... 123/357; 123/370

[58] Field of Search ..... 123/320, 373, 367, 462, 123/357, 358, 359

[56] References Cited

U.S. PATENT DOCUMENTS

| | | | |
|---|---|---|---|
| 4,090,785 | 2/1980 | Montgomery | 123/359 |
| 4,223,654 | 9/1980 | Wessell | 123/358 |
| 4,243,004 | 1/1981 | Ritter | 123/358 |
| 4,453,516 | 6/1984 | Filsinger | 123/357 |
| 4,502,437 | 3/1985 | Voss | 123/357 |
| 4,502,438 | 3/1985 | Yasohara | 123/357 |
| 4,502,440 | 3/1985 | Fronk | 123/358 |
| 4,566,068 | 1/1986 | Iwasaki | 123/357 |
| 4,566,414 | 1/1986 | Sieber | 123/357 |
| 4,850,320 | 7/1989 | Wokan | 123/359 |
| 4,917,063 | 4/1990 | Hiraki | 123/357 |
| 4,917,065 | 4/1990 | Law | 123/370 |
| 4,972,819 | 11/1990 | Engfer | 123/370 |

*Primary Examiner*—Carl S. Miller

*Attorney, Agent, or Firm*—Kent A. Herink; Brian J. Laurenzo; Brett J. Trout

[57] ABSTRACT

A method and apparatus for limiting the fuel to an internal combustion engine to reduce emissions of the engine. Means responsive to one or more operating conditions of the engine are provided for adjustably setting the maximum open position of a throttle of the engine so as to reduce and limit the maximum fuel volume flow rate to the engine. The operating conditions include the fuel flow rate called for by an accelerator, the condition of the transmission of a vehicle in which the engine is installed, the slope or incline on which the vehicle is located, the vehicle speed, and the speed and direction of any wind.

5 Claims, 8 Drawing Sheets

Distance: 1452 feet
Average grade: 1.55%

| | Average Speed | Fuel Used (Diesel) |
|---|---|---|
| Diesel only | 26.5 mph | 0.112 gal. |
| Alcohol added with factory settings | 23.5 mph | 0.093 gal |
| Reduction | 11.4% | 17.2% |

FUEL LIMITING METHOD AND APPARATUS FOR AN INTERNAL COMBUSTION VEHICLE

BACKGROUND OF THE INVENTION

The invention relates to a fuel limiting apparatus for an internal combustion vehicle and, more specifically, to an apparatus used to modify an internal combustion vehicle so that the maximum rate of fuel supplied to the engine is restricted according to a preselected schedule dependent upon the speed of the vehicle, the gear state of the transmission, or other operating conditions.

In the manufacture of internal combustion vehicles, the engines are typically sized to provide power to meet the maximum requirements of the particular application and design constraints of the vehicle. Operating conditions of the vehicle, however, vary over a wide range of power demands, particularly when considerations are made for fuel economy and reduction of polluting emissions from the vehicle. For example, as is well known, substantial amounts of fuel are wasted by full acceleration starts wherein the engine is over-fueled under the transient conditions. It is just being understood and appreciated that such full acceleration starts also result in substantial increases of emissions from the engine, particularly in the form of hydrocarbons and particulates. In an over-fuel condition, the engine is unable to burn fully all of the fuel with the result that uncombusted hydrocarbons are emitted. Such conditions also reduce the temperature of the combustion chamber which leads to an increase in the formation of particulate emissions.

The use of the full capacity of the engine power, particularly for high acceleration at low speeds, produces excessive stresses on the engine, the drive train of the vehicle, the suspension, and other components. While these effects have been long recognized and discouraged both by public agencies as well as private fleet owners, there has been heretofore no suitable way of forcing compliance with the recommended guidelines.

SUMMARY OF THE INVENTION

The invention consists of an apparatus for modifying an internal combustion vehicle so that the maximum rate of fuel supplied to the engine is limited to a preselected schedule that is determined according to the speed, condition of the vehicle transmission and/or acceleration conditions of the vehicle. The invention can take a number of specific forms corresponding to the particular internal combustion engine and vehicle on which it will be practiced. For example, with engines having sophisticated electronic control apparatus, the present invention would consist of a plurality of sensors attached to a central processing unit which is interconnected with and controls the electronic control apparatus of the internal combustion engine. Such sensors would detect and provide information to the central processing unit regarding the speed of the vehicle, the condition of the transmission of the vehicle, the attitude of the vehicle (whether it is on an up hill or down hill incline), any headwind conditions, and the position of the accelerator pedal that is ordinarily used to determine the demand for fuel to be supplied to the engine. The central processing unit would compare the conditions detected by the sensor with the preselected schedule of fuel rate that had previously been stored in a memory device. If the rate of fuel supply being demanded by the accelerator exceeded that of the schedule, the central processing unit would send a signal to the electronic control apparatus of the engine to restrict the rate of fuel being supplied to the engine to the preselected schedule amount.

In an alternative embodiment applicable to internal combustions which have mechanical means for controlling the rate of fuel supplied to the engine, the central processing unit controls a stepper motor which moves an adjustable stop for the fuel rate supply apparatus of the engine again to restrict the maximum rate of fuel to that of the preselected schedule.

In a third, less sophisticated embodiment, a plurality of linear actuators are used to adjust a stop for the fuel rate control apparatus of the engine. The actuators are adjusted to move the stop to a preselected position for each of the gears of the transmission of the vehicle. Accordingly, the maximum rate of flow of fuel that will be supplied to the engine when the vehicle is in the first or lowest gear of the transmission is set by the first linear actuator. A second, somewhat higher maximum amount of fuel rate is set to a preselected amount by movement of the stop by the second linear actuator, and so on for each of the higher gears.

With respect to each of the embodiments, the power lost due to limiting of the primary fuel of the engine can be partially compensated by the addition of a hydrous alcohol fuel into the intake manifold of the engine.

Accordingly, it is an object of the present invention to provide an apparatus for modifying an internal combustion vehicle to restrict the maximum flow rate of fuel to the engine according to a preselected schedule that is dependent on the speed of the vehicle.

Another object of the invention is to provide such an apparatus wherein the schedule is substantially continuous with changes in vehicle speed.

A further object of the invention is to provide such an apparatus wherein the schedule changes the maximum rate of flow of fuel to the engine in discrete steps that increase as the speed of the vehicle increases.

Yet another object of the invention is to provide such an apparatus wherein the maximum rate of fuel to the engine is restricted to a preselected value for each gear being used by the vehicle.

Still another object of the invention is to provide a fuel rate restricting apparatus which permits limitations on the power available from an engine to be preselected and outside the control of the operator of the vehicle.

Yet a further object of the invention is to provide an apparatus for restricting the maximum rate of fuel to an internal combustion engine which results in increased fuel efficiency and reduced emissions.

Still a further object of the invention is to provide an apparatus for restricting the maximum rate of fuel to an internal combustion engine wherein the fumigation of hydrous alcohol fuel into the intake manifold of the engine at least partially restores the decrease in engine power.

These and other objects of the invention will become apparent from the following description of the preferred embodiments.

DETAILED DESCRIPTION OF A PREFERRED EMBODIMENT

Figure 1:
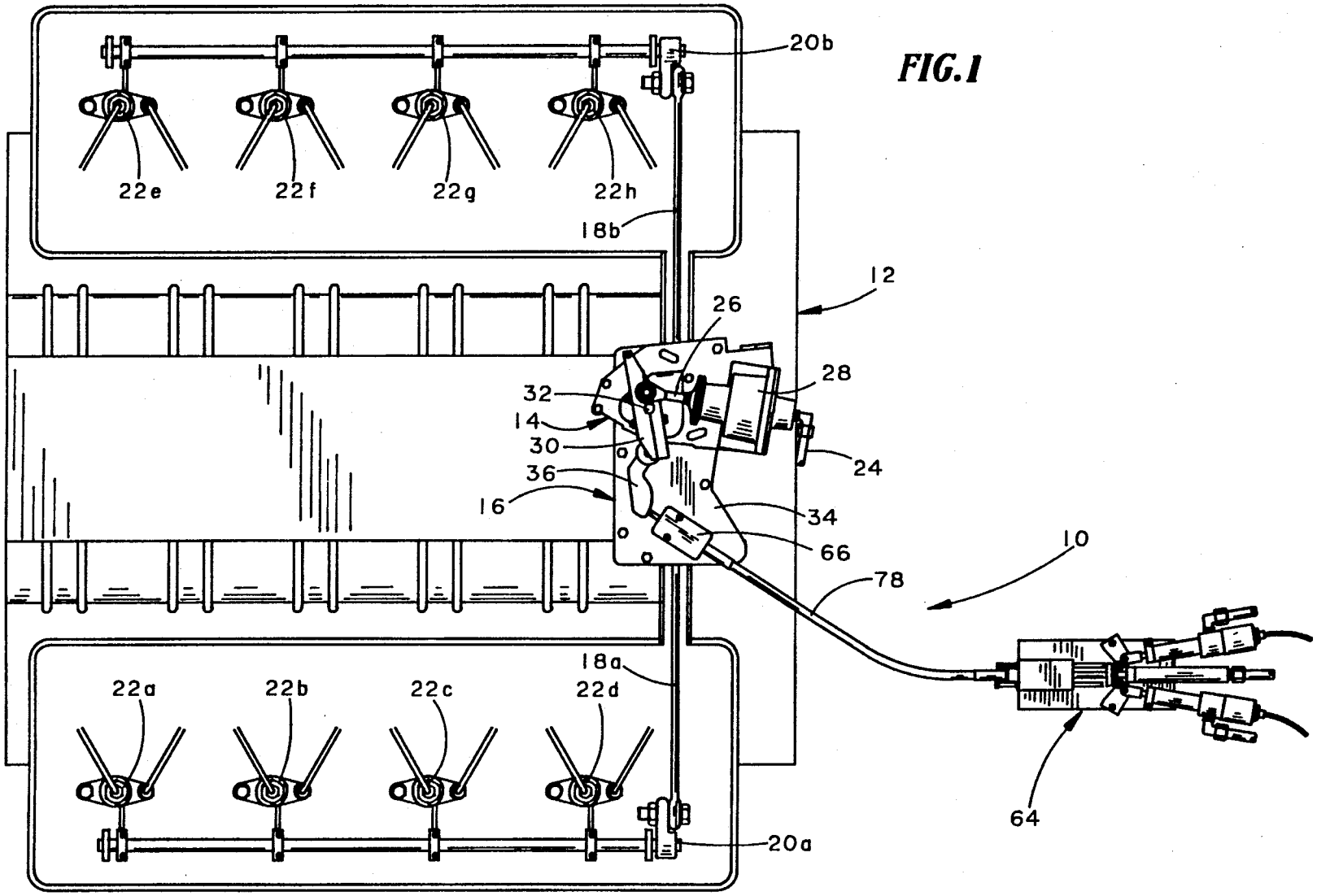
FIG. 1 is a partial plan view of an internal combustion engine which has been modified by the apparatus of the present invention.

Illustrated in FIG. 1, generally at 10, is a fuel rate limiting apparatus of the present invention shown attached to an internal combustion engine 12 of a vehicle. A throttle apparatus 14 is mounted atop a governor control box 16. A pair of connecting rods 18*a* and 18*b* extend in opposite directions from either side of the governor control box 16 to where they are pivotally attached at the outer end portion thereof to one of a pair of fuel injector adjustment racks 20*a* and 20*b*. Axial movement of the connecting rods 18 will thereby adjust the rate of fuel that will flow through a plurality of fuel injectors 22*a–h* for supply to the internal combustion engine 12.

The vehicle includes a foot-operated accelerator (not shown) of the usual type. Rather than being connected by a mechanical linkage to the throttle apparatus 14, the accelerator operates an air pressure sending unit which is connected to the throttle apparatus 14 by an air line 24. The pressure in the air line 24 (from 0 to 60 psi) causes a piston 26 of a valve unit 28 to be extended or retracted in response to changes in position of the foot accelerator. Extension and retraction of the piston 26 pivots a speed control lever 30 about its pivotal mount 32 atop the governor control box 16.

The governor control box 16 includes a top plate 34 on which is mounted the valve unit 28 and the speed control lever 30. Also mounted on the top plate 34 is a stop lever 36, the function of which will be described below. The stop lever 36 is mounted for pivotal movement on a vertical shaft which extends through the top plate 34. A return spring 38 received about the vertical shaft of the stop lever 36 below the top plate 34 biases the stop lever to its off or idle position. The pivotal mount 32 of the speed control lever 30 also extends through the top plate 34 and has attached to its bottom end portion a horizontally extended lever arm 40, the free end portion of which will be moved in an arc by pivotal movement of the pivotal mount 32 at the speed control lever 30.

A main operating shaft 42 is mounted for pivotal movement about a vertical axis inside the governor control box 16. Attached to the upper end portion of the operating shaft 42 is an operating shaft lever 44 having a pair of lever arms, stop arm 46 and throttle arm 48. A differential lever 50 is pivotally mounted on the free end portion of the throttle arm 48. The differential lever 50 includes a throttle linkage arm 52 that has a slotted or U-shaped end portion within which is received a connecting member 54 which depends from the horizontally extended lever arm 40. The differential lever 50 also includes a connecting bar arm 56 that will be pivoted together with the throttle linkage arm 52 by movement of the speed control lever 30 as described above. A connecting bar 59 is attached to the free end portion of the connecting bar arm 56 by a pivotal mount 58 such that pivotal movement of the differential lever 50 will cause axial movement of the connecting bar 59.

A throttle arm 61 is mounted for pivotal movement about a fixed axis at 63. One end portion 65 of the throttle arm 61 is pivotally attached to the end of the connecting bar 59 opposite the connecting bar arm 56. Accordingly, depression of the accelerator pedal will result in counterclockwise pivotal motion of the throttle arm 61. The connecting rod 18*b* is attached to the end portion 65 of the throttle arm 61 and the other connecting rod 18*a* is attached to the other end portion 67 of the throttle arm 61, with the result that the throttle arm 61 adjusts the volume rate of fuel flowing to the engine. The pivot rod 63 extends upwardly through the top plate 34 and is secured to and mounts for pivotal movement the stop lever 36. If the stop lever 36 is constrained against movement, the throttle arm 61 will also be constrained so that no further adjustment of the volume rate of fuel can be made.

Included in the governor control box is a governor weight assembly 60 mounted on a horizontal weight shaft 62 which is rotated at a speed corresponding to the speed of the engine. The governor acts in association with the operating shaft and stop arm 46 to provide a limit on the degree of motion of the connecting bar arm 56 in the usual manner by engagement of the connecting bar arm 56 with an adjusting screw 64 mounted on the free end portion of the stop arm 46.

The top plate 34 of the governor control box 16 ordinarily supports an adjustable stop which defines the maximum open position for the stop lever 36 and accordingly the maximum fuel rate flow to the engine 12. According to the present invention, an adjustable stop is provided which is adjustable in response to a preselected schedule so as to adjust the maximum flow rate of fuel to the engine 12 in conformance with one or more desired parameters. The apparatus for providing an adjustable stop includes a central actuator 64 and a remote slave unit 66. The central actuator 64 is mounted at any position convenient for the connection to the air line 24 from the foot accelerator pedal and the remote slave unit 66 is positioned on the top plate 34 of the governor control box 16 generally in the area in which the fixed stop was located.

Figure 2:
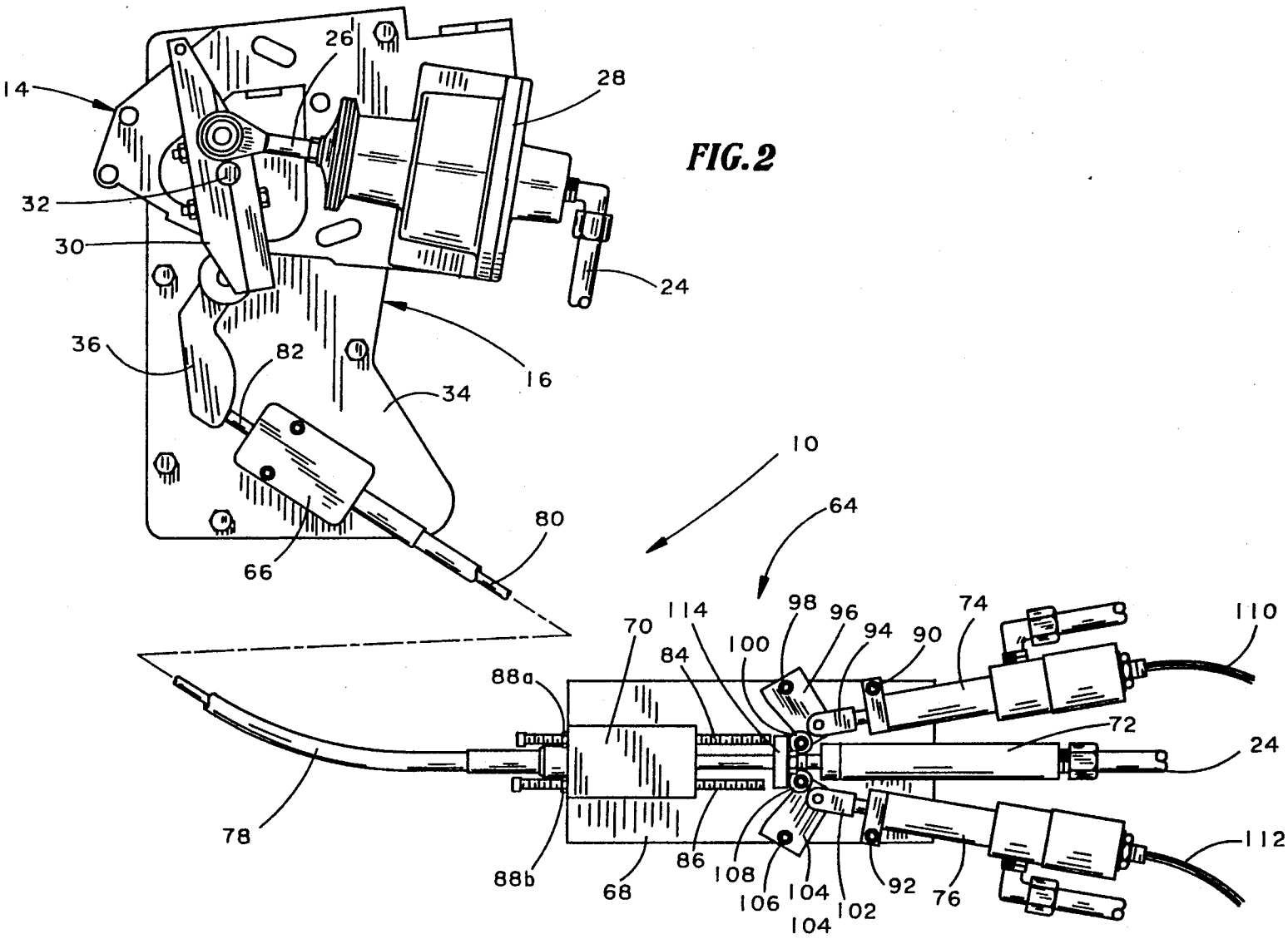
FIG. 2 is an enlarged detail view of the fuel rate restricting apparatus of FIG. 1.
Figure 3:
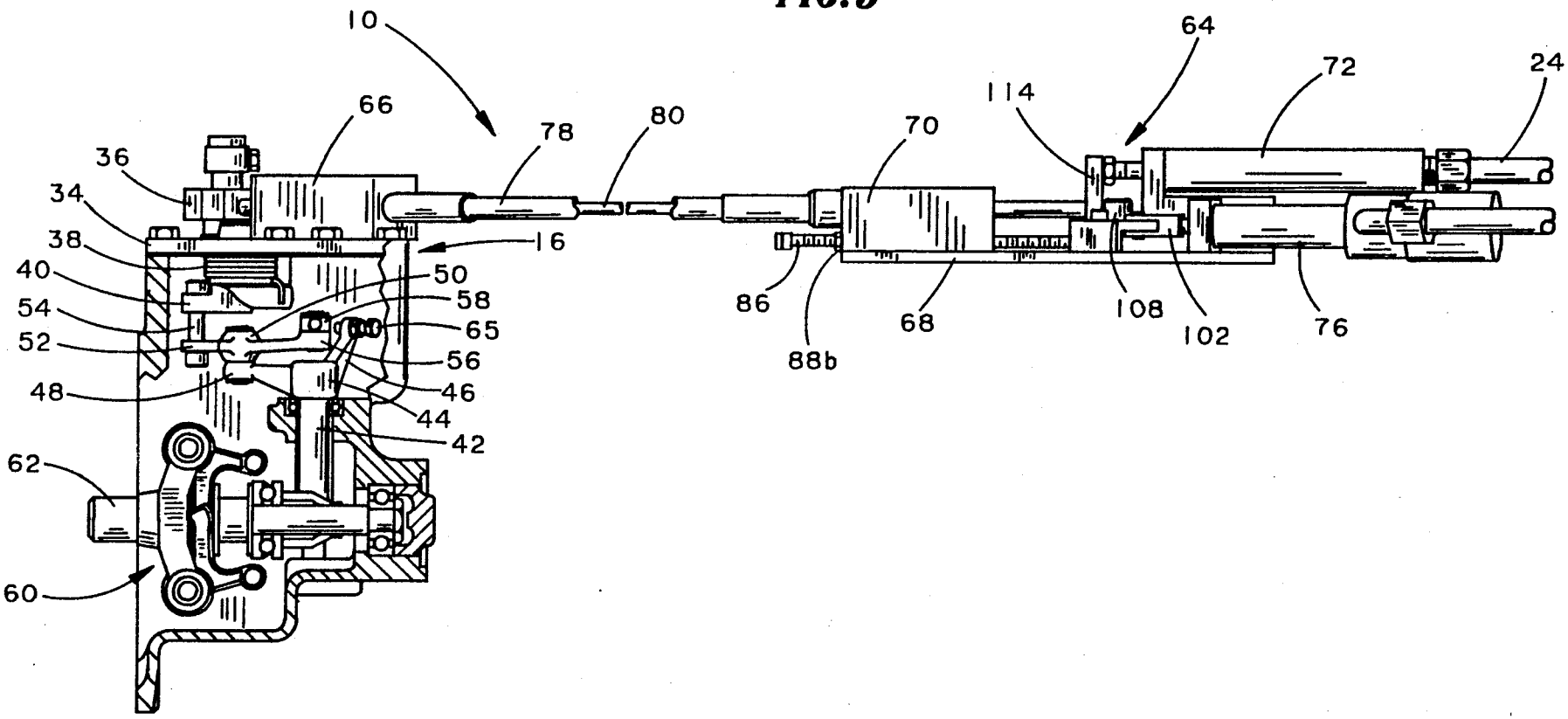
FIG. 3 is a side view corresponding to FIG. 2 with a part of the governor control box broken away to show parts interior of the governor control.

The central actuator 64, as illustrated in FIGS. 1–3, consists of a base plate 68 on which is mounted a block 70, an air-actuated extensible and retractable cylinder 72 and a first and second electrically controlled air cylinder 74 and 76, respectively. A cable 78 interconnects the remote slave unit 66 and the air cylinder 72 such that extension and retraction of an intercoaxial cable portion 80 by the air cylinder 72 results in extension and retraction of a piston stop member 82 of the remote slave unit 66. The outer coaxial portion of the cable 78 is fixed to the block 70 and to the outer housing of the remote slave unit 66.

Mounted in the block 70 and extended in the line of action of the air cylinder 72 are a pair of threaded stop members, first stop member 84 and second stop member 86. The positions of the end portions of the first and second stop members 84 and 86 are adjustable to a desired fixed position by a corresponding lock nut 88*a* or 88*b*. As illustrated in FIG. 2, first stop member 84 extends from the block 70 somewhat closer to the air cylinder 72 than does second stop member 86.

The first and second electrically controlled air cylinders 74 and 76 are pivotally mounted at 90 and 92, respectively, on the base plate 68 on either side of the air cylinder 72. The free end of an extensible and retractable piston 94 of the first electrically controlled air cylinder 74 is pivotally attached to a first pivot block 96 mounted for pivotal movement at 98 on the base plate 68. A roller 100 is mounted for rotational movement on the first pivot block 96 in a similar fashion, the free end portion of a piston 102 of the second electrically controlled air cylinder 76 is pivotally mounted to a second pivot block 104 which is pivotally mounted at 106 to the base plate 68. The second pivot block 104 also supports for rotational movement a second roller 108.

Figure 4:
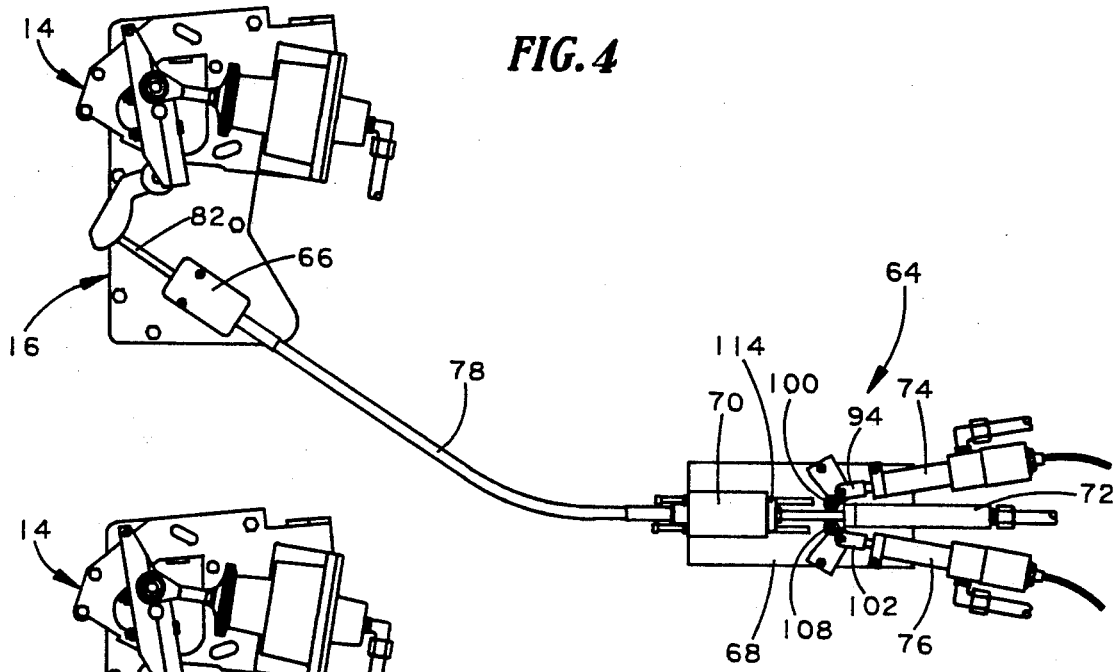
FIGS. 4–6 are reduced scale plan views of the apparatus shown in three different conditions corresponding to the settings for the three gears of the transmission of the vehicle.
Figure 5:
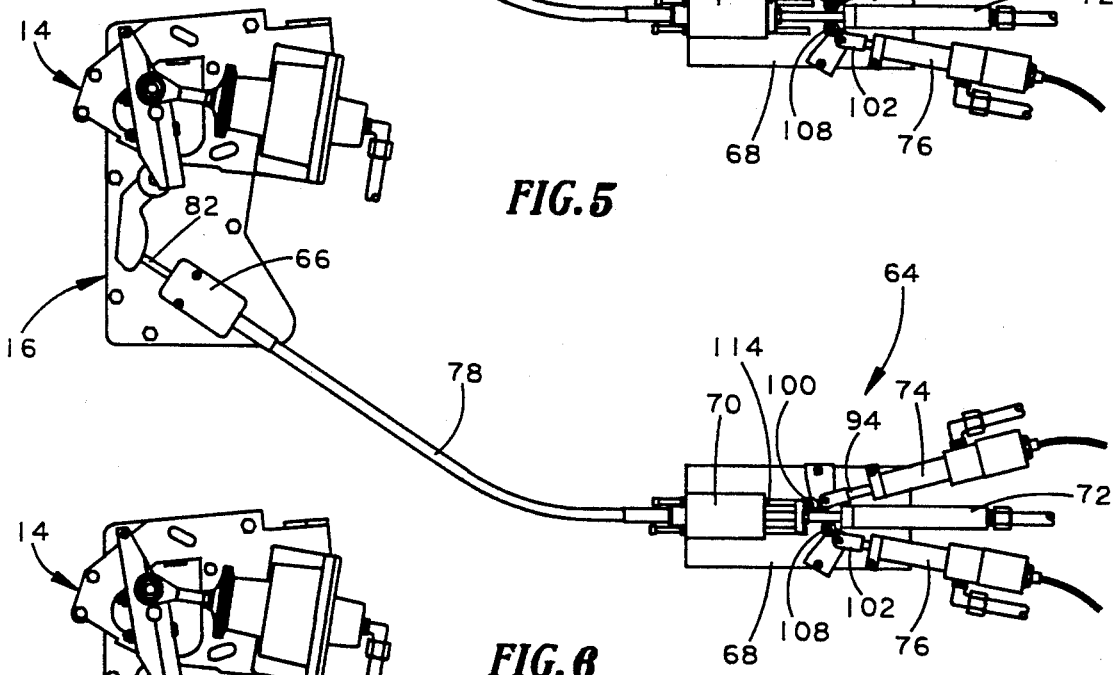

Each of the air cylinders 72–76 are connected to the air line 24. The air cylinders 74 and 76 are also connected by means of electrical cable 110 and 112, respectively, to a transponder connected to the three-speed transmission (not shown) of the vehicle. Accordingly, the air cylinder 72 extends and retracts in response to the position of the accelerator pedal such that upon full extension, as illustrated in FIG. 4 wherein a plate 114 attached to the free end portion of piston abuts the block 70, corresponds to the minimum or idle position of the accelerator pedal. In this position, the intercoaxial cable 80 is at its maximum extended position from the remote unit 66. As the accelerator pedal is depressed, the linear actuator 72 will retract the piston and plate 114 until it comes into contact with either of the rollers 100 or 108. If the transmission is in first gear, corresponding to FIG. 5, the first electrically controlled air cylinder 74 will be extended until the roller 100 comes into contact with the first stop member 84. Contact of the plate member 114 with the first roller 100 will stop retraction of the air cylinder 72 whether or not the foot accelerator pedal has been depressed beyond that corresponding location. This will result in retraction of the intercoaxial cable 80 so as to permit additional counterclockwise movement of the stop lever 36.

Figure 6:
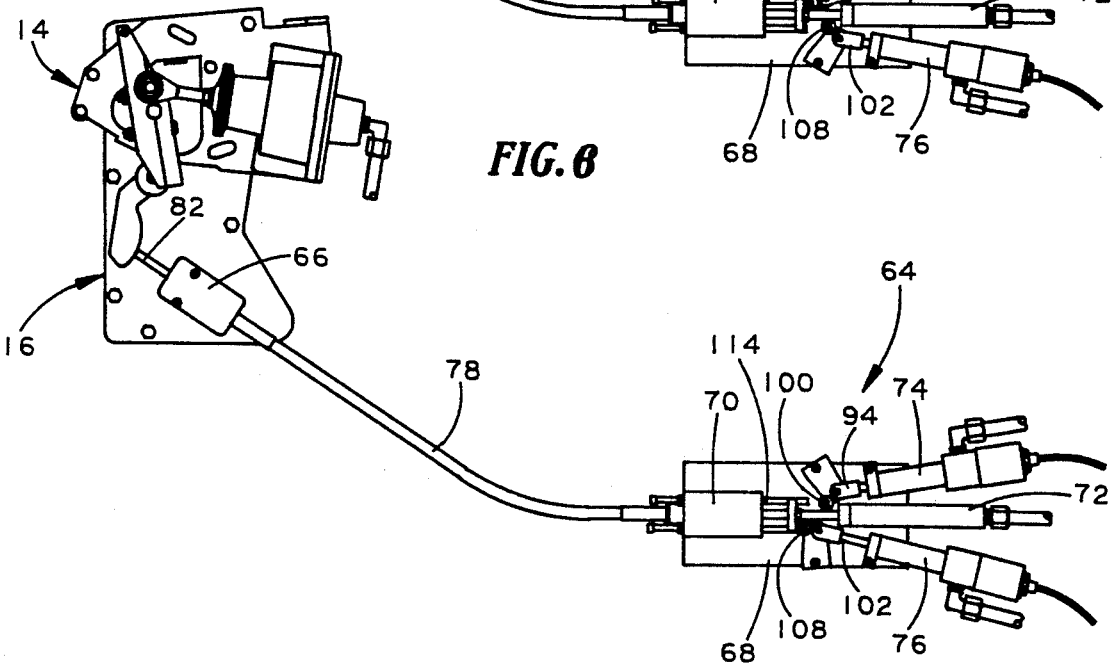

If instead the transmission of the vehicle is in second gear, the first electrically controlled air cylinder 74 will be retracted and the second electrically controlled air cylinder 76 will be extended until the roller 108 comes into contact with the second stop member 86, as illustrated in FIG. 6. In this condition, depression of the foot accelerator will retract the air cylinder 72 until the plate 114 comes into contact with the roller 108. As before, the extension of the intercoaxial cable 80 beyond the remote slave unit 66 will be adjusted to provide a stop position for the stop lever 36.

Finally, if the transmission of the vehicle is in the third gear, both electrically controlled air cylinders 74 and 76 will be fully retracted, as illustrated in FIG. 4, so that full depression of the accelerator pedal will allow retraction of the air cylinder 72 until the plate member 114 comes into contact with the rollers 100 and 108. The central actuator has been constructed and adjusted so that this position allows the full rate of fuel delivery to the engine as was permitted by the unmodified engine.

The present invention is advantageously employed on an internal combustion engine modified as described in U.S. Pat. No. 4,958,598 which is incorporated herein by this reference. The '598 patent teaches the use of a low proof hydrous alcohol fuel used to supplement the primary fuel of the engine. The FIGS. 9–12 represent graphically data taken from a General Motors RTS 30-foot bus having a 8V71 Detroit Diesel non-turbocharged engine modified with the apparatus of the present invention as disclosed in FIGS. 1–6 of this application and the apparatus of the '598 patent. The modified bus was tested for acceleration and smoke opacity over typical urban route conditions and these data are compared with data taken from the unmodified bus under identical conditions.

Figure 8:
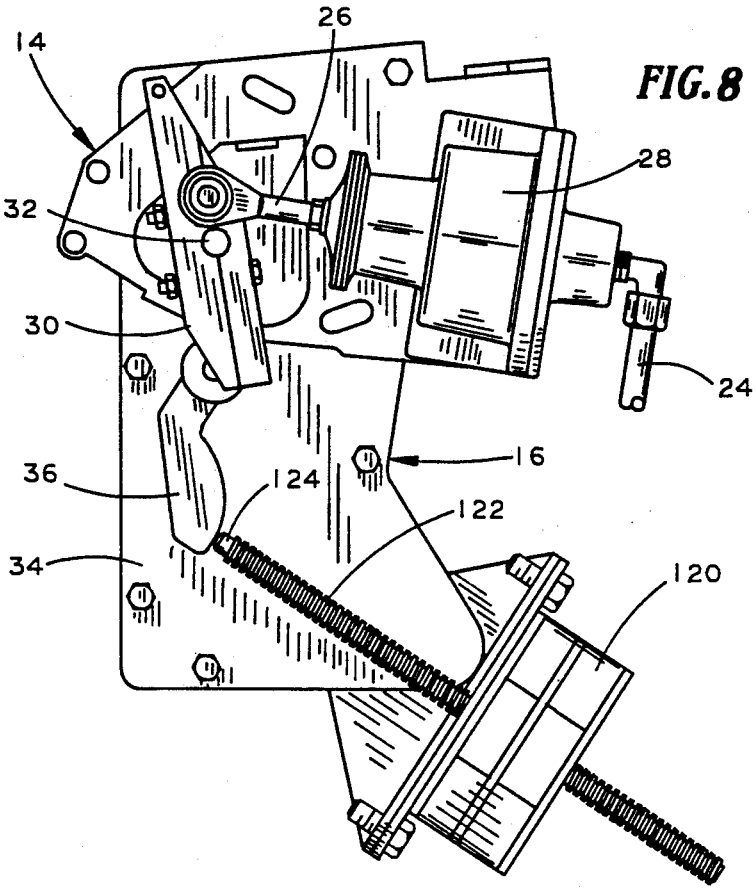
FIG. 8 is a plan view of another alternative embodiment wherein the maximum fuel rate of the mechanical fuel rate control apparatus of the engine is adjusted by a stepper motor.
Figure 7:
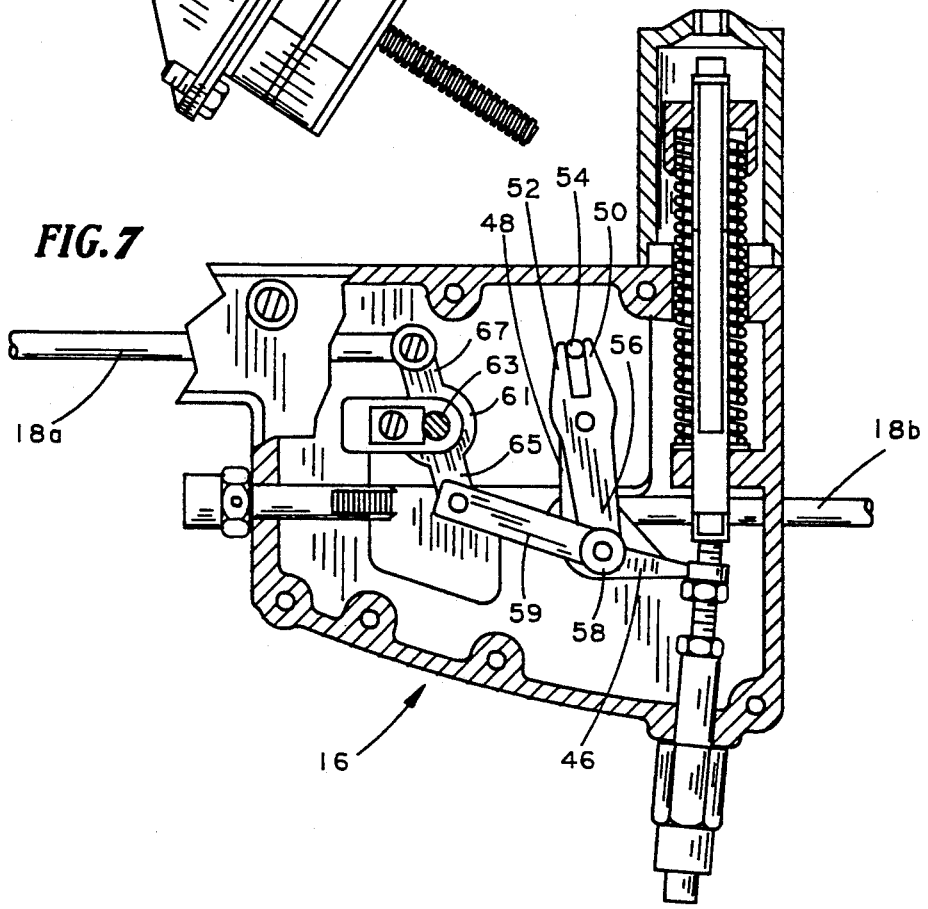
FIG. 7 is a plan view of the governor control box with parts broken away to show interior parts of the governor control.

As an alternative embodiment, a stepper motor 120 is mounted on the top plate 34 of the governor control box 16 (FIG. 8). The stepper motor 120 has a screw 122 that is extensible and retractable in fine, exact and reproducible increments. The end 124 of the screw 122 serves as a stop for the stop lever 36 in the same fashion as did the end of the cable 80 (FIGS. 2, 4–6) in the first embodiment. The stepper motor 120 is electrically controlled and may be conveniently operated by a microprocessor that is connected to a plurality of tranducers for sensing various operating conditions, such as vehicle velocity, pitch or incline of the vehicle, and wind direction and speed. A potentiometer adjusted by the accelerator pedal is also connected to the microprocessor. The stepper motor 120 is capable of adjusting the position of the stop lever 36 in approximately 500 substantially equally spaced divisions to permit a much greater degree of flexibility in the limiting of maximum fuel flow rate to the engine under a plurality of operating conditions.

Figure 9:
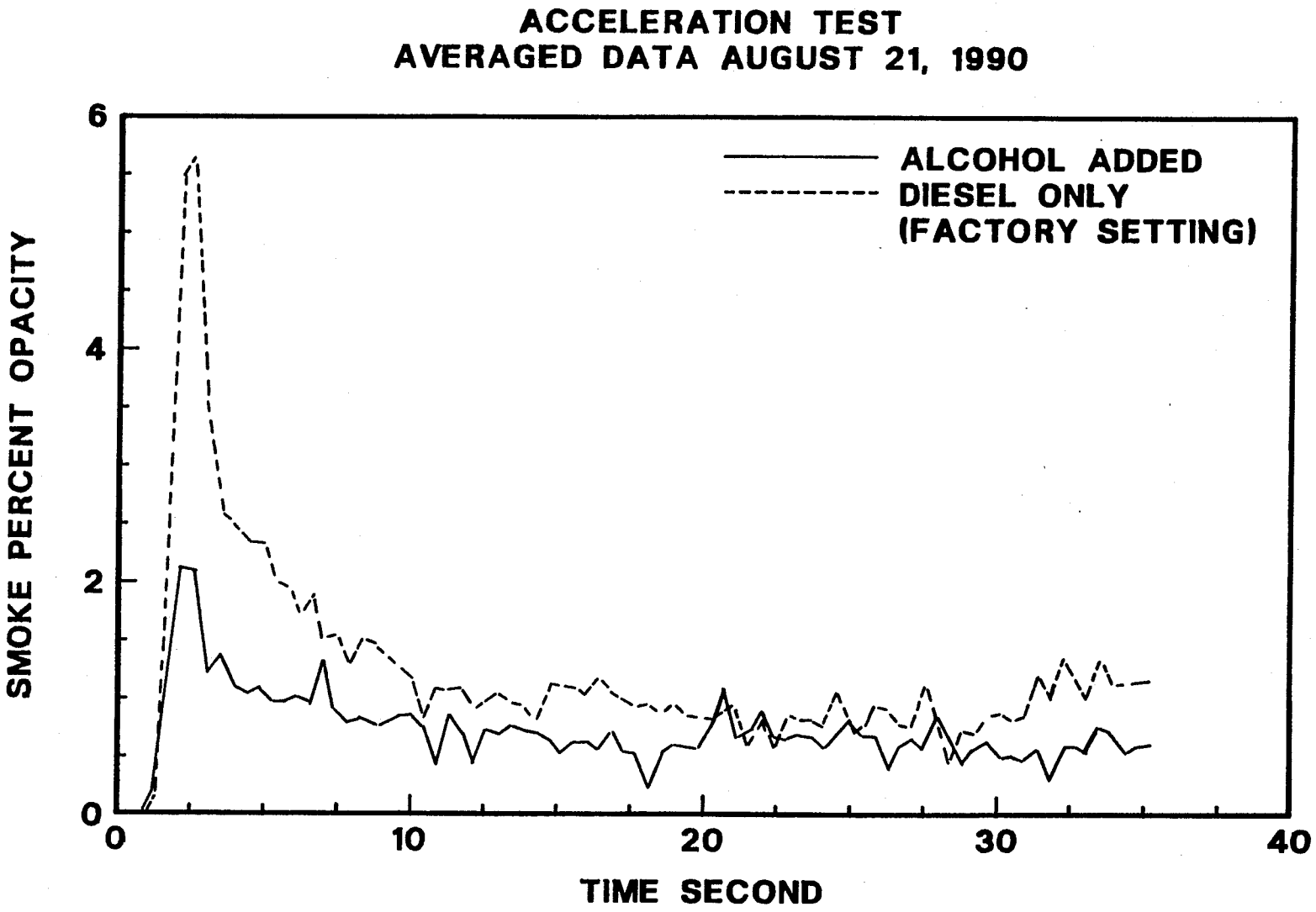
FIG. 9 is a graphical representation of vehicle acceleration versus time for a vehicle unmodified and as modified by an embodiment of the present invention.

In FIG. 9, acceleration of the two vehicles over time is represented, showing that some decrease in acceleration was experienced. This decrease, however, was not so noticeable as to be the subject of negative comment by the drivers of the vehicles.

Figure 10:
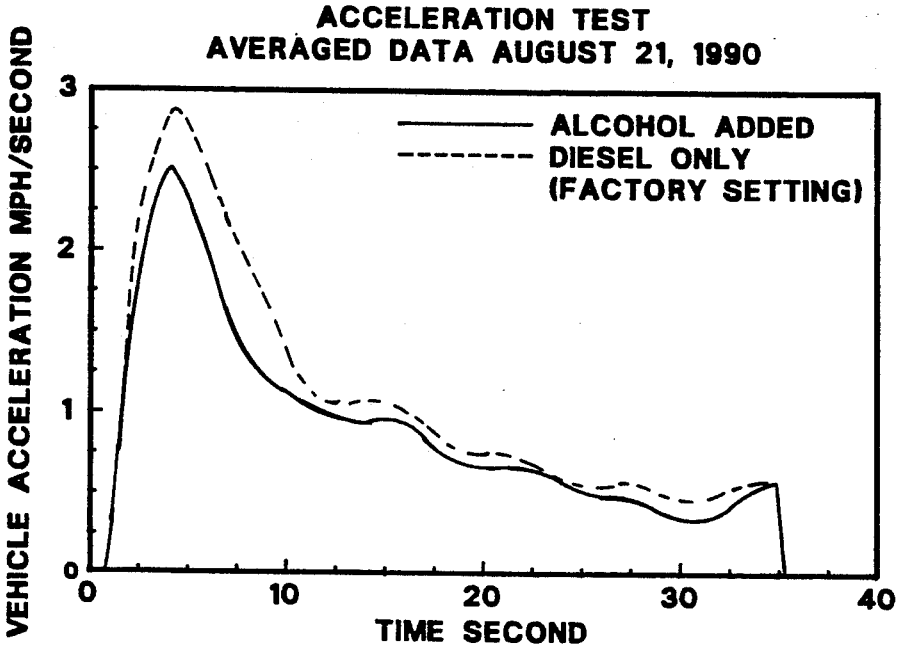
FIG. 10 is a graphical representation of vehicle speed versus time for a vehicle unmodified and as modified by an embodiment of the present invention.

Velocity of the two vehicles over time is illustrated in FIG. 10. Again, some reduction in performance was observed, i.e., a reduction in average speed (over a distance of 1452 feet with an average grade of 1.55 percent) of from 26.5 m.p.h. to 23.5 m.p.h. However, a primary fuel savings of 17.2 percent was realized.

Figure 11:
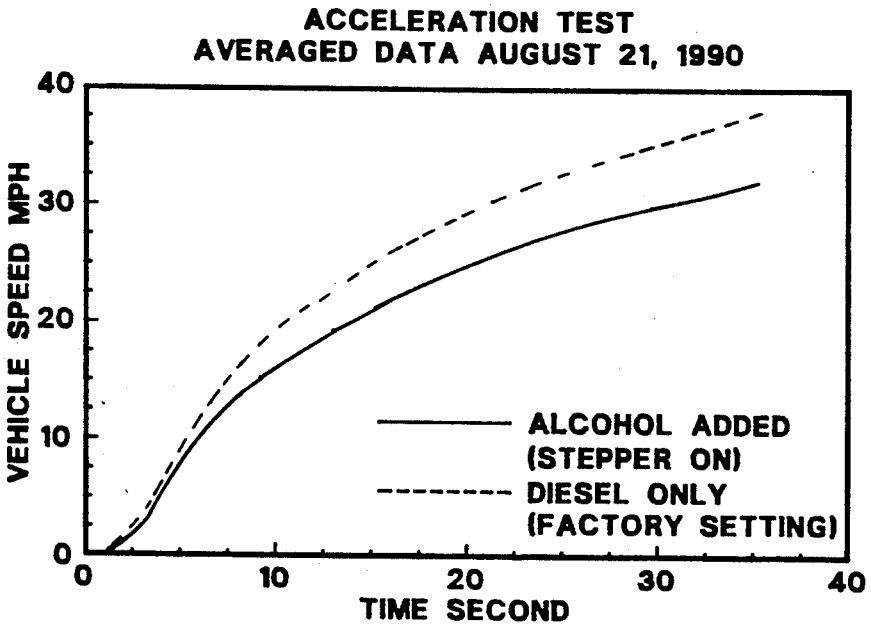
FIG. 11 is a graphical representation of smoke opacity versus time for a vehicle unmodified and as modified by an embodiment of the present invention.
Figure 12A:
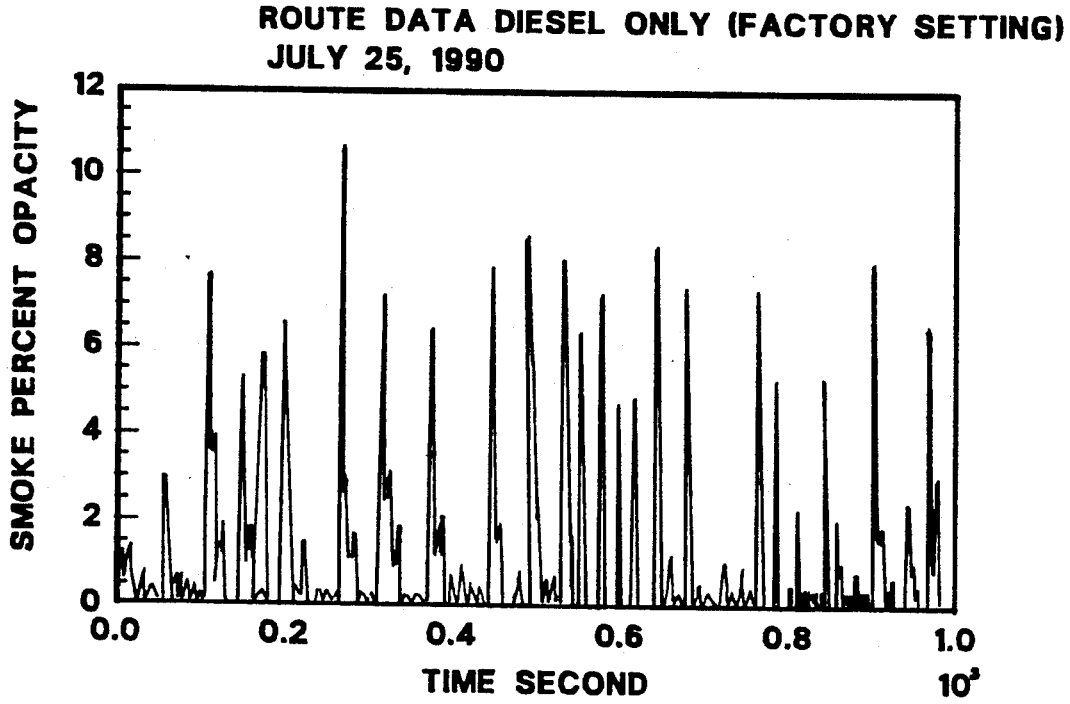
FIGS. 12*a* and 12*b* are graphical representations of smoke opacity versus time for a vehicle unmodified and as modified by an embodiment of the present invention wherein the vehicles are driven over identical routes.
Figure 12B:
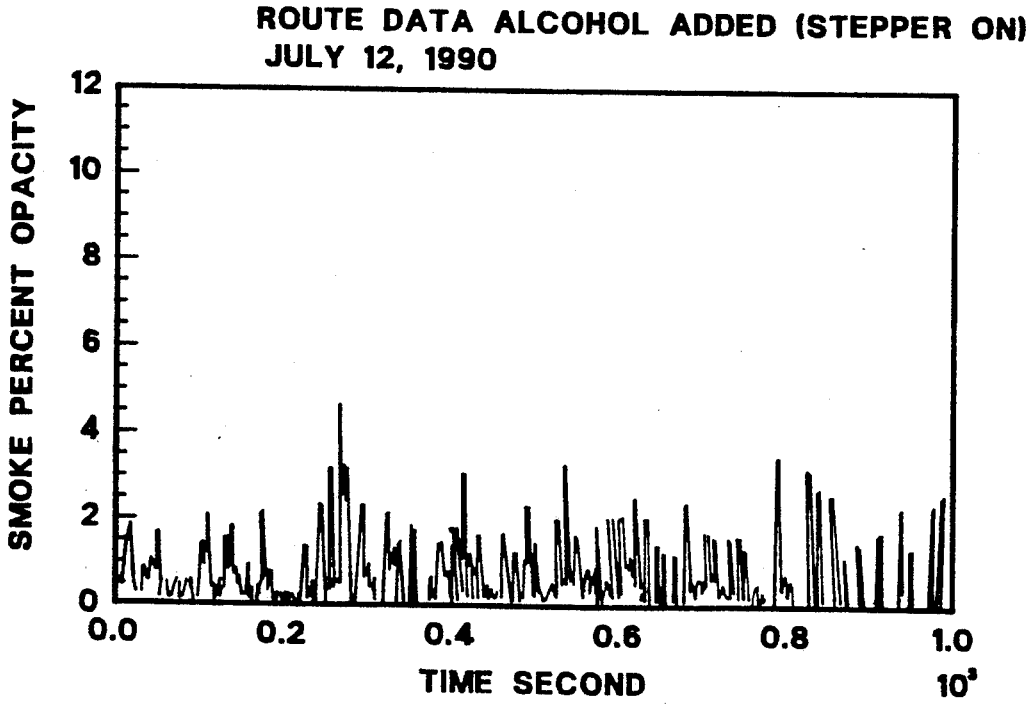

The opacity of exhaust emitted by the two vehicles was measured over the acceleration sequence of FIG. 9 by using a Celisco opacity meter, model 200, as shown in FIG. 11. The modified vehicle had substantially reduced opacity of the emission particularly during the early stages of the acceleration sequence. Smoke opacity measurements over a typical urban route of the unmodified vehicle (FIG. 12*a*) and the modified vehicle (FIG. 12*b*) were measured. The reduction in emission opacity is marked.

I claim:

1. Fuel limiting apparatus for an internal combustion engine operably connected to a transmission capable of being operated in a first gear and a second gear, the apparatus including throttle means through which fuel is supplied to the engine controlled by an accelerator, comprising:

a. means for limiting to a first value the maximum fuel flow rate through the throttle means called for by the accelerator to thereby reduce maximum power output of the engine to a first power output, wherein said first power output is less than an unrestricted power output of the engine resulting from an unrestricted fuel flow through the throttle;

b. means for increasing to a second value the maximum fuel flow rate through the throttle means called for by the accelerator to thereby increase said maximum power output of the engine to a second power output, said second power output being greater than said first power output;

c. wherein said first value limiting means reduces said maximum power output of the engine to said first power output when the transmission is being operated in the first gear; and d. wherein said second value increasing means increases the maximum power output of the engine to said second power output when the transmission is being operated in the second gear.

2. Fuel limiting apparatus for an internal combustion engine installed in a vehicle, the engine including throttle means through which fuel is supplied to the engine controlled by an accelerator, comprising:

a. means for limiting to a selected one of a plurality of fixed values the maximum fuel flow rate through the throttle means called for by the accelerator to thereby reduce the maximum power output of the engine;

b. means for sensing the incline of the vehicle; and c. wherein said maximum fuel flow rate is adjusted in response to vehicle acceleration according to a preselected schedule.

3. Fuel limiting apparatus as defined in claim 1 wherein the engine is installed in a vehicle and further comprising means for sensing the acceleration of the vehicle and wherein said selected fixed value of said maximum fuel flow rate is adjusted in response to vehicle acceleration according to a preselected schedule.

4. Fuel limiting apparatus as defined in claim 1 wherein said selected fixed value of said maximum fuel flow rate results in a decrease in emissions from said engine.

5. Fuel limiting apparatus as defined in claim 1 wherein said second power output is equal to said unrestricted power output of the engine resulting from said unrestricted fuel flow through the throttle.

* * * * *